United States Patent [19]

Osberghaus et al.

[11] Patent Number: 4,528,717

[45] Date of Patent: Jul. 16, 1985

[54] FLAT PRESS

[75] Inventors: Reiner Osberghaus, Düsseldorf; Bernfried Scheller, Pulheim; Franz Kresse, Hilden; Ferdinand Hesse, Düsseldorf; Roland Schunter, Lorch-Waldhausen, all of Fed. Rep. of Germany

[73] Assignee: Floordress-Reinigungsgeräte GmbH, Lorch-Waldhausen, Fed. Rep. of Germany

[21] Appl. No.: 548,073

[22] Filed: Oct. 31, 1983

[30] Foreign Application Priority Data

May 5, 1983 [DE] Fed. Rep. of Germany ..... 3316499

[51] Int. Cl.[3] ..... A47L 13/59

[52] U.S. Cl. ..... 15/261; 100/116; 100/211

[58] Field of Search ..... 15/261; 68/241; 100/116, 211

[56] References Cited

U.S. PATENT DOCUMENTS

| | | | |
|---|---|---|---|
| 1,247,078 | 11/1917 | Carver | 100/116 X |
| 2,626,519 | 1/1953 | Pfeiffer | 100/211 X |
| 3,452,379 | 7/1969 | Bard | 15/261 X |
| 3,872,695 | 3/1975 | Busek | 68/241 X |

*Primary Examiner*—Chris K. Moore

*Attorney, Agent, or Firm*—Michael J. Striker

[57] ABSTRACT

A flat press for squeezing fluid out of a moist element which is attached to a support has a base provided with a plurality of throughholes for allowing discharge of the fluid and a cover movable towards the base so as to be pressed thereagainst. For squeezing or pressing out, the elements are introduced between the base and the cover together with the support. In order to provide a higher degree of dryness during the pressing, the base and if necessary the cover are provided with a lining of elastic material, for example of foam rubber.

23 Claims, 4 Drawing Figures

FLAT PRESS

BACKGROUND OF THE INVENTION

The invention relates to a flat press for squeezing out moist elements, like wiping cloths or mops, which are clamped to a support.

Presses for squeezing out of moist wiping cloths are known and are usually arranged above a bucket. In these presses, the moist element is introduced and is squeezed out between a bottom or base portion and a cover or top portion which are movable relative to each other. Prior to introduction, the moist element must, however, be removed from the support and reattached thereto after pressing out the moisture. This is cumbersome and requires considerable time. Moreover, the degree of dryness of the element obtainable upon such pressing is relatively low. This is due to the fact that the element is introduced into the press in a disordered manner in form of a clew, and/or also due to the fact that foreign bodies, for example little stones, get caught on the fringes of the elements which prevent a complete pressing.

SUMMARY OF THE INVENTION

It is a general object of the present invention to avoid the prior-art disadvantages. In particular, it is an object of the present invention to create a press which provides a higher degree of dryness during the squeezing out of wet elements.

Another object of the present invention is to provide a press which does not require the removal of the element from the support.

In keeping with these objects and with others which will become apparent hereinafter, one feature of the present invention resides in a flat press for squeezing fluid out of a moist element, comprising a base provided with a plurality of throughholes for allowing discharge of the fluid and having a surface; a cover movable towards the surface of the base; and a lining covering the surface of the base and having a plurality of flow passages so that upon movement of the cover towards the base the fluid is squeezed out from the element and discharged.

Preferably, the lining is a plate which is adjusted to the shape and size of the base and consists of rubber, especially foam rubber or rubber sponge.

According to another feature of the invention, the cover is provided at its underside also with a lining of elastic material, for example a plate of foam rubber or rubber sponge. The thickness of the plates connected to the base as well as to the cover is for example 0.5–2.5 cm. However, it is to be understood that the thickness is not necessarily limited to this stated range but may also be of a different value.

Preferably, the surface of the plates is provided with an essentially impervious layer or a layer which does not absorb any fluid.

According to a further feature of the invention, means are provided for moving the cover towards the bottom and include at least one handle having two shanks spaced from each other along the width of the cover and pivotally arranged thereto, so that upon actuation of the handle the latter moves the cover towards the bottom for squeezing fluid out of the moist element. Preferably, at least one of the shanks is formed as a two-armed angle lever, wherein one of the two levers has one end abutting an associated side wall which is fixed to the base. The side wall is advantageously provided with a roller path along which the one end of the one lever rolls by means of a roller during actuation of the handle.

Through the provision of such a lever bars structure it is possible that only a small hand force must be applied to the handle in order to provide the required force for squeezing out the element, and moreover the handle occupies only a minimum of space.

In order to return the handle to its initial position when no manual force is applied thereon, at least one return spring is provided having one end cooperating with the respective shank of the handle and another end fixedly associated to the cover.

The novel features which are considered characteristic for the invention are set forth in particular in the appended claims. The invention itself, however, both as to its construction and its method of operation, together with additional objects and advantages thereof, will be best understood from the following description of specific embodiments when read in conjunction with the accompanying drawing.

DESCRIPTION OF THE PREFERRED EMBODIMENTS

Figure 1:
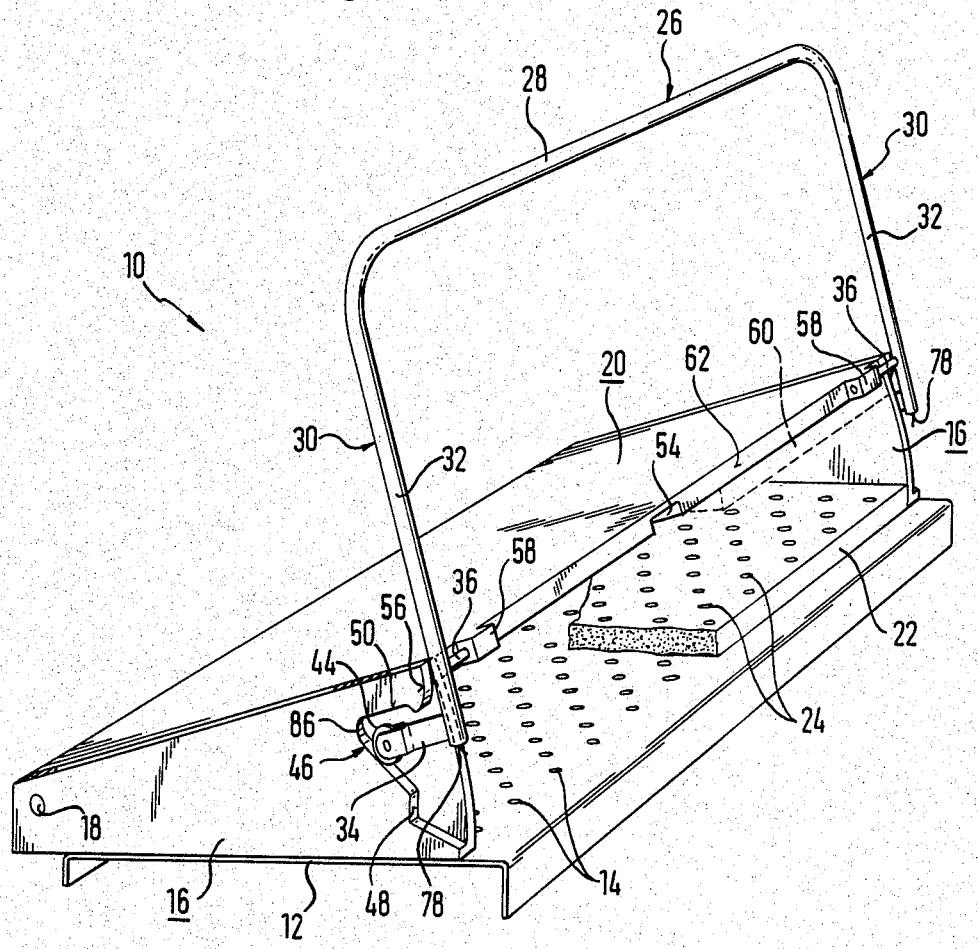
FIG. 1 is a perspective illustration of a flat press according to the invention.

Referring firstly to FIG. 1, there is shown a flat press 10 having a base or bottom 12, for example of aluminum sheet. The base 12 is provided with a plurality of throughholes 14 for drainage of a fluid, for example water, which is to be squeezed out from the wet elements, such as wiping cloths or mops. Fixedly connected to the base 12 are two side walls 16 which support an axle 18 extending transversely thereto. Pivotally arranged to the axle 18 is a cover 12, as explained hereinafter.

The side walls 16 are provided essentially in a wedge-shaped manner, extending from the rear to the front. In FIG. 1, the flat press 10 is shown in its initial position, that is in unactuated state, in which the cover 20 extends under an acute angle to the base 12, so that the foremost end of the flat press 10 provides a rectangular opening between the cover 20 and the base 12 for allowing introduction of the wet elements.

The base 12 is provided with a lining 22 of elastic material at the surface facing the cover 20 and consists as disclosed in the present embodiment of a plate of foam rubber or rubber sponge. The plate or lining 22 is provided with flow passages 24 which are arranged in such a manner that each flow passage 24 is in alignment with a throughhole 14 provided in the base 12. The plate 22 can have a thickness of approximately 0.5–2.5 cm. It is to be understood, however, that the range of the thickness, as mentioned, can also differ therefrom. The form and the size of the plate 22 is adjusted to the base 12 and can be fixed thereto in any manner, for example by screws, strips, through adhesion, or by inserting the plate on the base 12 wherein its front end face is fixed to the base 12 by a respective edge portion or collar (not shown).

The plate 22 can consists of a porous foam rubber or rubber sponge and has a surface which is advantageously provided with an essentially impervious or water-repellant layer, that is a thin (1–2 mm thick) rubber layer with smooth surface which is essentially free of pores. Consequently, the elasticity and deformability of the foam rubber is maintained, on the one hand, while the reception of water is prevented by the rubber plate, on the other hand.

As indicated in dotted lines, the underside of the cover 20 facing the base 12 can also be provided with a lining 16 of elastic material which, corresponding to the lining 22, can consist of a rubber plate corresponding to the plate 22, except that the lining 16 is not provided with flow passages. The lining 16 is adjusted to the shape and size of the cover 20 and fixed thereto by any suitable means, for example by means of suitable screws and strips, or by gluing with commercial water-resistant synthetic resin adhesives.

For actuation of the flat press 10, a handle 26 is provided and is made for example of pipe material. The handle 26 has a handlebar 28, on each side thereof a shank 30 being arranged rectangularly to the handlebar 28. Each of the shanks 30 is developed in form of an angled lever consisting of a lever arm 32 and a lever arm 34. In the present embodiment, the lever arms 32, 34 are arranged at an angle of 90°, but it is to be noted that also different angles may be provided.

Connected to each lever arm 32 is a trunnion 36 which extends transversely and inwardly with respect to the lever arm 32 and parallel to the foremost end face of the cover 20. Each of the trunnions 36 is pivotally arranged in an associated bearing block 58, as will be explained with reference to FIG. 2.

The lever arms 34 arranged at an angle with respect to the lever arms 32 are essentially provided in the plane of the side walls 16. As especially clearly shown in FIG. 4, each of the side walls is provided with a cam or roller path 46 which cooperates with the free end of the lever arm 34. As shown in FIG. 1, the free end of the respective lever arm 34 is provided with a roller 44 which abuts the roller path 46 upon actuation of the handle 26 in such a manner that the roller 44 rolls along the curvature 86 while the handle 26 is pivoted around its trunnion 36. During this pivoting, the cover 20 is pressed downwardly against the base 12, as will be explained hereinbelow.

Figure 2:
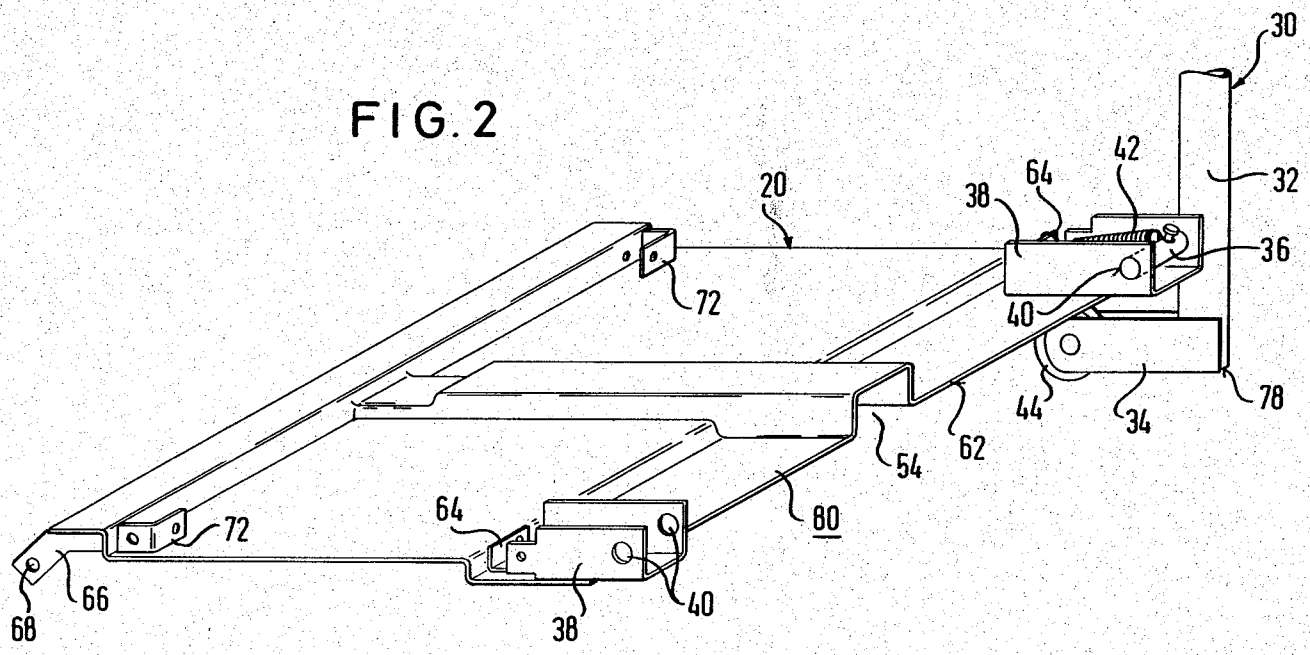
FIG. 2 is a perspective illustration of a cover showing in detail the connection of the handle thereto for actuating the press.

The cover 20, which is shown in perspective illustration in FIG. 2, is further covered by a hood as shown in FIG. 1.

The cover 20 consists of a shaped plate 80, for example of aluminum, on whose surface turned away from the base 12 a U-shaped shackle 38 is mounted at each forward and outer end. Each of the shackles 38 has two boreholes 40 whose axis is parallel to the front end face 62 of the cover 20.

As shown in FIG. 2, the trunnion 36 fixed to the respective lever arm 32 of the handle 26 is pivotally arranged in the associated boreholes 40 of the shackle 38. Each of the shackles 38 further accommodates a return spring 42 in form of a spiral tension spring whose one end is connected to a web 54 of the shackle 38, while its other end is fixed to the periphery of the trunnion 36, for example by means of a screw. Consequently, when the trunnion 36 is rotated, the return spring 42 is tensioned, which is the case when the handle 26 is pivoted for closing the flat press 10.

The U-shaped shackles 38 according to FIG. 2 form the bearing blocks 58 according to FIG. 1.

Figure 3:
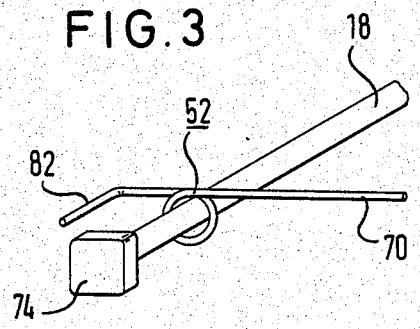
FIG. 3 is a partial view of an axle around which the cover according to FIG. 2 is pivotable.

As further shown in FIG. 2, the cover 20 is provided at its rear end at each side with a base plate 66 which has a borehole 68 through which the axle 18 extends. The axle 18 is supported in the side wall 16 as will be described hereinbelow. The cover 20 is thus supported on the axle 18 and pivotable therearound. Two return springs 52 act on the axle 18. As can be seen from FIG. 3, which illustrates only one return spring 52, the one end 70 of the return spring 52 cooperates with a rod 22 fixed to the cover 20 by engaging a respectively developed borehole, while the other end 82 of the return spring 52 is stationarily fixed with respect to the axle 18 or suitably anchored in the side wall 16. The lugs 72 and the shackles 38 are for example welded or screwed with the cover 20.

Figure 4:
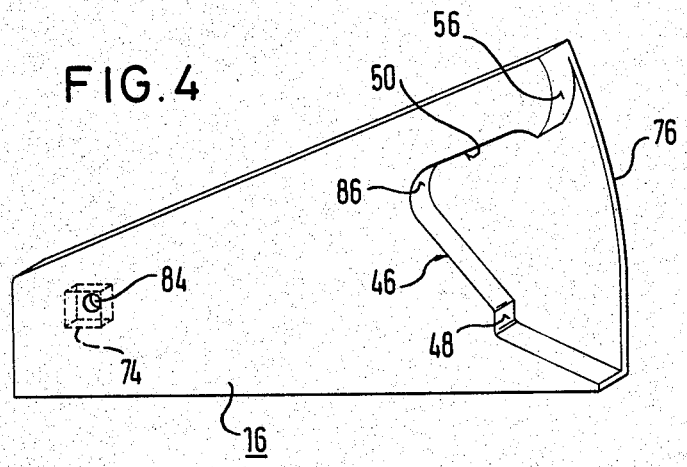
FIG. 4 is a perspective view of a side wall of the press, illustrating a roller path for the handle for actuating the press.

As can be especially seen from FIG. 4, each side wall 16 is provided for example of two shells with an interior wall 76 and an outer wall not specifically characterized. In the inner wall 76, a borehole 84 is provided for the axle 18, each end thereof being provided with a head portion 74 which is located between the walls of the side wall 16 and consequently is fixed and immovable in axial direction.

In the initial position, that is upon open press as shown in FIG. 1, the lever arm 32 abuts an essentially circular-shaped curved end face 56 of the side wall 16. In this position the roller 44 has no contact with the roller path 46. When the handle 26 is pivoted around the trunnion 36, the roller 44 is then brought into contact with the roller path 46 in the area of the curvature 86 and upon further pivoting of the handle 26 eventually runs to and along the pressure section 50. The handle 26 can be pivoted until the lower end face 78 of the lever arm 32 abuts a stop member 48 of the roller path 46, as can be seen from FIG. 1. However, it is also possible to provide the curved portion at the end of the pressure section 50 as stop member for the end position of the handle, so that in this case the roller 44 abuts this curved portion.

Approximately in the center with respect to the width of the cover 20, the latter is provided with a channel-shaped or rib-shaped recess 54 upwardly projecting away from the base 12. The recess 54 serves on the one hand for reinforcing the cover 20 and it is to be noted that for this purpose also several ribs of this or similar shape can be provided, and on the other hand to receive the grip of the moist element upon introducing the latter into the press, so that the squeezing or pressing of the actual element is not obstructed by the grip.

The flat press according to the invention operates as follows:

The wet or moist element is introduced into the open press as shown in FIG. 1. Then, the handle 26 is gripped at its handlebar 28 and forwardly pivoted towards the operator. During this pivoting movement, the rollers 44 located at the respective end of each lever arm 34 come into contact with the associated roller path 46, wherein the rollers 44 at least temporarily act as centers of rotation. The handle 26 is thus pivoted downwardly and the cover 20 is thus moved via the trunnions 36 which are fixed to the lever arms 32 of the handle, since the trunnions 36 are supported in the shackles 38 of the cover 20. The cover 20 is then pivoted around its axle 18, while the handle 26 is rotated around the center axis of its trunnions 36, on the one hand, and is pivoted around the respective point of support of the rollers 44 on the roller path 46 on the other hand.

In case the handle 26 is released by the operator, the handle is returned to its initial position by the action of the return springs 42, and the cover 20 is returned by the return springs 52.

It is certainly conceivable that the pressing force can be changed by for example modifying the diameter of the rollers 44, or by increasing the pressure section 50 of the roller path 56, that is by reducing the distance of the pressure section 50 to the roller 44.

Through the provision of the flat press according to the present invention, a very high degree of dryness is obtained during the squeezing of the moist elements. This is based on the fact that solid dirt particles, like for example small stones or the like which get caught in the fringes of the elements are impressed into the soft material of the rubber plate during the squeezing, so that despite such foreign bodies both pressure plates, i.e. the base and the cover, are firmly pressed against each other.

If necessary, the cover 20 can be provided at its rearward portion with a projection 88 extending upwardly away from the base 12 for receiving the support of the elements during the squeezing process.

It will be understood that each of the elements described above, or two or more together, may also find a useful application in other types of flat presses differing from the types described above.

While the invention has been illustrated and described as embodied in a flat press, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for varios applications without omitting features that, from the standpoint of prior art, fairly constitute essential characteristics of the generic or specific aspects of this invention.

What is claimed as new and desired to be protected by Letters Patent is set forth in the appended claims:

1. A manually operable flat press for squeezing fluids out of a moist element, comprising: a base provided with a plurality of throughholes for allowing discharge of the fluid, and having a surface; a cover pivotable towards the surface of the base; and a lining covering the surface of the base and having a plurality of flow passages so that upon movement of the cover towards the base the fluid is squeezed out from the element and discharged.

2. A press as defined in claim 1, wherein the lining is of elastic material so that it can be temporarily deformed by the cover to compensate for irregularities and foreign bodies in the moist element.

3. A press as defined in claim 1, wherein the base has a shape and size, the lining being a plate having a shape and size adjusted to the shape and the size of the base.

4. A press as defined in claim 3, wherein the plate has a thickness of 0.5–2.5 cm.

5. A press as defined in claim 3, wherein the plate is of rubber.

6. A press as defined in claim 5, wherein the plate is of foam rubber.

7. A press as defined in claim 1, wherein each of the throughholes of the base is in alignment with a respective one of the flow passages of the lining.

8. A press as defined in claim 1, wherein the cover has an underside facing the surface of the base; and further comprising a further lining provided at the underside of the cover.

9. A press as defined in claim 8, wherein the further lining is of elastic material so that it can be temporarily deformed by the cover to compensate for irregularities and foreign bodies in the moist element.

10. A press as defined in claim 9, wherein the cover has a size and a shape, the further lining being a plate having a shape and a size adjusted to the size and the shape of the cover.

11. A press as defined in claim 10, wherein the plate has a thickness of 0.5–2.5 cm.

12. A press as defined in claim 10 wherein the plate is of rubber.

13. A press as defined in claim 12 wherein the plate is of foam rubber.

14. A flat press for squeezing fluids out of a moist element, comprising: a base having a shape and size and provided with a plurality of throughholes for allowing discharge of a fluid, and having a surface; a cover movable toward the surface of the base; and a lining formed as a plate having a shape and size adjusted to the shape and size of the base, and having a surface provided with a water impervious layer, the plate covering the surface of the base and having a plurality of flow passages so that upon movement of the cover towards the base the fluid is squeezed out from the element and discharged.

15. A press as defined in claim 14, wherein the impervious layer is a rubber layer free of pores.

16. A press as defined in claim 15, wherein the rubber layer has a thickness of 1–2 mm.

17. A flat press for squeezing fluids out of a moist element, comprising: a base provided with a plurality of throughholes for allowing discharge of a fluid, and having a surface; a cover movable toward the surface of the base and having a size and a shape, and an underside facing the surface of the base; a lining covering the surface of the base and having a plurality of flow passages so that upon movement of the cover towards the base the fluid is squeezed out from the element and discharged; and a further lining formed as a plate of elastic material having a shape and size adjusted to the size and shape of the cover, and provided at the underside of the cover.

18. A flat press for squeezing fluids out of a moist element, comprising: a base provided with a plurality of throughholes for allowing discharge of the fluid, and having a surface; a cover having a width and being movable towards the surface of the base; a lining covering the surface of the base and having a plurality of flow passages so that upon movement of the cover towards the base the fluid is squeezed out from the element and discharged; and means for moving the cover towards the base including at least one handle having two shanks spaced from each other along the width of the cover and being pivotally arranged thereto so that upon actuation of the handle it moves the cover towards the base for squeezing the fluid out of the moist element.

19. A press as defined in claim 18; and further comprising two side walls, each of which is fixedly connected to one side of the base and extends perpendicularly to the latter, at least one of the shanks being formed as a two-armed angled lever, one of the two levers having one end abutting the associated side wall.

20. A press as defined in claim 19; and further comprising a roller, the associated side wall accommodating a roller path wherein the one end of the one lever is provided with the roller which upon actuation of the handle rolls along the roller path.

21. A press as defined in claim 18; and further comprising means for returning the handle into its initial position when the handle is released after moving the cover towards the base.

22. A press as defined in claim 21, wherein the returning means include at least one return spring having one end cooperating with the shank of the handle and another end fixedly associated with the cover.

23. A press as defined in claim 22, wherein the return spring is a spiral tension spring.

* * * * *